US009708083B2

(12) United States Patent
Eberle et al.

(10) Patent No.: US 9,708,083 B2
(45) Date of Patent: Jul. 18, 2017

(54) THERMOFORM PACKAGING MACHINE AND METHOD

(71) Applicant: Multivac Sepp Haggenmüller GmbH & Co. KG, Wolfertschwenden (DE)

(72) Inventors: Guido Eberle, Betzigau (DE); Dieter Holzem, Erolzheim (DE); Martin Drechsler, Trunkelsberg (DE); Ewald Rimmel, Kleinweiler (DE)

(73) Assignee: MULTIPAC SEPP HAGGENMUELLER SE & CO. KG, Wolfertschwenden (DE)

( * ) Notice: Subject to any disclaimer, the term of this patent is extended or adjusted under 35 U.S.C. 154(b) by 675 days.

(21) Appl. No.: 14/133,508

(22) Filed: Dec. 18, 2013

(65) Prior Publication Data

US 2014/0165511 A1 Jun. 19, 2014

(30) Foreign Application Priority Data

Dec. 18, 2012 (DE) ..... 10 2012 024 725

(51) Int. Cl.

| | |
|---|---|
| ***B65B 9/04*** | (2006.01) |
| ***B65B 47/04*** | (2006.01) |
| *B65B 31/02* | (2006.01) |
| *B65B 35/38* | (2006.01) |
| *B65B 61/06* | (2006.01) |
| *B65B 61/08* | (2006.01) |
| *B65B 5/06* | (2006.01) |

(52) U.S. Cl.

CPC ..... *B65B 9/04* (2013.01); *B65B 47/04* (2013.01); *B65B 5/06* (2013.01); *B65B 31/028* (2013.01); *B65B 35/38* (2013.01); *B65B 61/065* (2013.01); *B65B 61/08* (2013.01)

(58) Field of Classification Search

CPC .. B65B 9/04; B65B 47/04; B65B 5/06; B65B 31/028; B65B 35/38; B65B 61/065; B65B 61/08; B65B 63/022; B65B 35/56; B65B 47/10; B65B 5/108; B65B 5/08

USPC .... 425/63, 64, 65, 110; 53/453, 559, DIG. 1

See application file for complete search history.

(56) References Cited

U.S. PATENT DOCUMENTS

| | | | | |
|---|---|---|---|---|
| 3,129,545 A * | 4/1964 | Sloan | B29C 51/267 53/511 |
| 3,216,832 A * | 11/1965 | King | B65B 31/028 426/119 |
| 3,303,628 A * | 2/1967 | Lovas | B29C 51/18 226/173 |
| 3,323,273 A * | 6/1967 | Lee | B65B 11/54 53/133.7 |
| 3,325,966 A | 6/1967 | Bruce et al. | |

(Continued)

FOREIGN PATENT DOCUMENTS

| | | |
|---|---|---|
| CN | 1671594 A | 9/2005 |
| CN | 102233959 A | 11/2011 |

(Continued)

*Primary Examiner* — Gloria R Weeks
*Assistant Examiner* — Lucas Palmer
(74) *Attorney, Agent, or Firm* — Husch Blackwell LLP

(57) ABSTRACT

The present invention relates to a thermoform packaging machine and a method of operating a thermoform packaging machine, which comprises an infeed station and a pre-sealing station, so as to feed elongate products into troughs and retain them therein until a cover film has been fixed so as to cover the troughs.

17 Claims, 7 Drawing Sheets

(56) References Cited

U.S. PATENT DOCUMENTS 3,349,540 A * 10/1967 Jensen ..... B65B 9/02 118/240
3,524,298 A * 8/1970 Hamilton ..... B65B 9/04 53/433
3,660,962 A * 5/1972 Bliss ..... B65B 11/50 53/442
3,762,125 A * 10/1973 Prena ..... B32B 37/223 156/495
3,775,932 A * 12/1973 Jeney ..... B29C 65/7847 425/388
3,805,486 A * 4/1974 Mahaffy ..... B65B 9/04 425/388
3,874,143 A * 4/1975 Braber ..... B29C 51/422 53/133.8
4,034,536 A * 7/1977 Mahaffy ..... B29C 51/22 53/427
4,035,984 A * 7/1977 Gerlach ..... B65B 9/06 53/202
4,064,676 A * 12/1977 King ..... B65B 11/52 53/427
4,349,997 A * 9/1982 Hayasaka ..... B65B 41/18 156/351
4,555,894 A * 12/1985 Illy ..... A23F 5/125 53/528
4,730,761 A * 3/1988 Spano ..... B26D 7/1863 225/103
4,897,985 A * 2/1990 Buchko ..... B65B 9/02 53/553
4,915,283 A * 4/1990 Buchko ..... B29C 31/00 198/803.7
5,091,199 A * 2/1992 Mally ..... B65D 71/72 206/485
5,105,603 A * 4/1992 Natterer ..... B29C 65/18 53/133.4
5,319,910 A * 6/1994 Takata ..... B32B 7/06 493/355
5,329,750 A * 7/1994 Bagley ..... B65B 11/50 53/281
5,426,919 A * 6/1995 Natterer ..... B65B 65/00 198/841
5,454,206 A * 10/1995 Bailer ..... B65B 59/00 53/157
5,682,729 A * 11/1997 Buchko ..... B26D 1/045 53/251
5,943,842 A * 8/1999 de Koning ..... B65B 35/38 294/65
6,282,866 B1 * 9/2001 Natterer ..... B65B 7/164 198/833
7,775,017 B2 * 8/2010 Stowell ..... B29C 65/305 53/281
7,833,002 B2 * 11/2010 Buchko ..... B29C 51/04 425/383
7,922,614 B2 * 4/2011 Ruzic ..... B65B 41/14 474/206
8,539,743 B2 * 9/2013 Rapparini ..... B65B 9/042 53/122
9,180,987 B2 * 11/2015 Grimm ..... B65B 9/04
2003/0196412 A1 * 10/2003 Foulke, Jr. ..... B65B 31/028 53/432
2004/0000128 A1 * 1/2004 Di Lauretis ..... B29C 51/24 53/453
2004/0016205 A1 * 1/2004 Douglas ..... B65B 61/188 53/133.4
2009/0035435 A1 * 2/2009 Stanojevic ..... B26D 1/553 426/518
2009/0045549 A1 * 2/2009 Parini ..... B29C 49/0047 264/320
2009/0241485 A1 * 10/2009 Buchko ..... B29C 51/04 53/543
2009/0241486 A1 * 10/2009 Buchko ..... B65B 9/04 53/556
2011/0023421 A1 * 2/2011 Izquierdo ..... B65B 9/045 53/477
2011/0293397 A1 * 12/2011 Lomerson, Jr. ..... B25J 15/0052 414/800
2012/0096809 A1 * 4/2012 Grimm ..... B65B 41/18 53/396
2013/0074453 A1 * 3/2013 Walsh ..... B65B 35/30 53/443

FOREIGN PATENT DOCUMENTS

DE 1229897 12/1966
DE 2327286 12/1973
DE 2327286 A1 * 12/1973 ..... B65B 9/04
DE 2545739 A1 * 4/1976 ..... B65B 9/04
EP 1486439 A2 12/2004
GB 1523122 A 8/1978
IT WO 2008129350 A1 * 10/2008 ..... B65B 9/042
WO 2008129350 A1 10/2008
WO 2012100956 A1 8/2012

* cited by examiner

THERMOFORM PACKAGING MACHINE AND METHOD

CROSS-REFERENCE TO RELATED APPLICATIONS

This Application claims priority to German Patent Application No. 10 2012 024 725.7 filed Dec. 18, 2012, to Guido Eberle, Dieter Holzem, Martin Drechsler and Ewald Rimmel entitled "Thermoform Packaging Machine and Method," currently pending, the entire disclosure of which is incorporated herein by reference.

FIELD OF THE INVENTION

The present invention relates to a thermoform packaging machine and method.

BACKGROUND OF THE INVENTION

Up to now, products have, in practice, been positioned on or fed into packaging carriers at an infeed station so as to convey them, together with the packaging carriers, from the infeed station along a packaging line to downstream work stations, such as a sealing station. In the sealing station, a cover film is sealed onto the packaging carriers for hermetically sealing the products in the packaging carriers.

Conveying (transporting) the products on the packaging carriers between the infeed station and the sealing station does not cause any problems as long as the products do not shift on the packaging carriers. Such shifting may have the effect that they move into the packaging carrier area where the cover film is to be sealed on subsequently. This is normally a boundary area or the area of the sealed seam of the packaging carrier.

In particular the conveyance of long, flexible and partially curved products proved to be problematic, since such products tend to shift on the packaging carriers while they are being conveyed or since, for example, one end of the product projects beyond the packaging carrier simply in view of a curvature of the respective product. This has the effect that the products project beyond the packaging carriers and get into the area where sealing is intended to be carried out subsequently.

In order to detect shifting of the products, camera systems are used in practice. When the camera system detects that the products are no longer appropriately positioned on or in the packaging carriers, (i.e., project into the area to be sealed), the packaging process is stopped automatically. Subsequently, the operator must correct the position of the products on or in the packaging carriers so that the packaging process can continue. This is disadvantageous primarily insofar as the camera system used for this purpose is expensive and the automatic stopping of the packaging process leads to downtimes, whereby manufacturing costs are increased.

It has also turned out in practice that shifting of the products on the packaging carriers is caused primarily by vibrations of the packaging machine, by cyclic feeding along the conveyor path, by closing the sealing tool of the sealing station and also by restoring forces of the products as such. Primarily, however, the cyclic advance of the products on the packaging carriers along the packaging line is considered responsible for the circumstance that the products, while being conveyed, move away from their original position and possibly into the packaging carrier area to be sealed.

SUMMARY OF THE INVENTION

It is therefore the object of the present invention to improve a thermoform packaging machine and a method such that, during the packaging process, the products to be packed will be prevented from moving into a packaging carrier area to be sealed, so that interruptions during the packaging process will be avoided.

According to one embodiment the present invention, a thermoform packaging machine comprises a forming station for forming troughs in a film or foil, an infeed station (viz. loading station) and a sealing station with a sealing tool, for feeding (loading) a group of preferably long, flexible and partially curved products into the troughs. The thermoform packaging machine is characterized in that a holder may be provided for retaining the products in the troughs, and that a relative movement in a production direction can be provided between the holder and the sealing tool, whereby the products can be held reliably in the troughs and sealing, as well as full sealing of the troughs, is carried out such that reliable processing is ensured, without part of the product being located in the sealed seam and damage caused to the product and without a package that is not suitable for use being produced. The sealing station may be a sealing station for producing a circular closed sealed seam, but it may also be a pre-sealing station for fixing a cover film or foil partially to the film with the troughs so as to retain the products in the trough until the troughs are fully sealed in an additional sealing station thus forming packages.

The holder may comprise clamping jaws configured for retaining products at a plurality of positions in the troughs and the film, so as to guarantee that each part of an elongate product, preferably both ends of the product, are retained in the trough.

According to one embodiment, the holder comprises a plurality of clamping strips, which are movable relative to one another in parallel and each of which has clamping jaws attached thereto, so as to allow a simultaneous movement of a plurality of clamping jaws for all troughs. Also a variant with rotatively acting means is imaginable for allowing the movement of a plurality of clamping jaws. Likewise, it is imaginable that only the clamping jaws for a respective single trough can be operated in common, so as to support manual feeding in of the products or the feeding in of individual products.

The clamping strips may be moved in common by means of an adjustment drive relative to one another such that the clamping jaws retain the products in the troughs.

According to one embodiment, the holder comprises a plurality of holding segments arranged on a circulating feed system. This provides a simple and space-saving possibility of conveying the holding segments or a format in the production direction and, after the pre-sealing station, also back to the infeed station. The feed system may comprise a link chain, a toothed belt or comparable means for transmitting the driving force.

The holder can be adapted to be intermittently conveyed in synchronism with a film conveying unit for the film in a production direction into the sealing station for sealing a cover film onto the film.

According to one embodiment, the holder is mechanically coupled to the film conveying unit for the film so that it is not necessary to provide a separate drive for the holder and the circulating feed system, respectively.

A gripper can be provided for feeding a group of preferably long, flexible and partially curved products into the troughs so as to increase the degree of automation of the thermoform packaging machine still further.

According to another embodiment, the holder includes a downholder configured for retaining products at a plurality of positions in the troughs and the film.

The holder may include here a die for the group of products, the die being vertically movable by means of a lifting device. This offers the advantage that only one die is required for receiving therein troughs of a format and that only a vertical direction of movement has to be provided for the die.

The pre-sealing tool can be movable in a direction opposite to the production direction across the die for pre-sealing a cover film onto the film.

The method according to one embodiment of the present invention for operating an intermittently working thermoform packaging machine for packaging a group of preferably long, flexible and partially curved products comprises the following production steps:

forming troughs in a film, feeding the group of products into the troughs in an infeed station, the troughs being positioned in a holder or a die during feeding in, and holding the products by means of a plurality of clamping jaws or a downholder while the holder or the die executes a movement relative to a sealing tool of a sealing station.

The method according to the present invention may guarantee that, after having been fed in, the products will be retained reliably in the respective trough until the troughs have been covered by a cover film and until, by means of a sealing tool, the cover film has been fixed to the film or sealed with a circumferentially extending continuous sealed seam.

Retaining of the products can begin here when the products have been fed in, and ends after sealing.

According to one embodiment, the holder includes a format of holding segments, and the format of holding segments is moved in a production direction into the sealing station.

After sealing, the holder may be conveyed back to the infeed station preferably by means of a circulating chain feed system.

According to one embodiment of the method, the products are fed into the troughs by means of a gripper so as to increase the degree of automation of the method.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Identical components are provided with identical reference numerals throughout the figures.

DETAILED DESCRIPTION OF THE INVENTION

Figure 1:
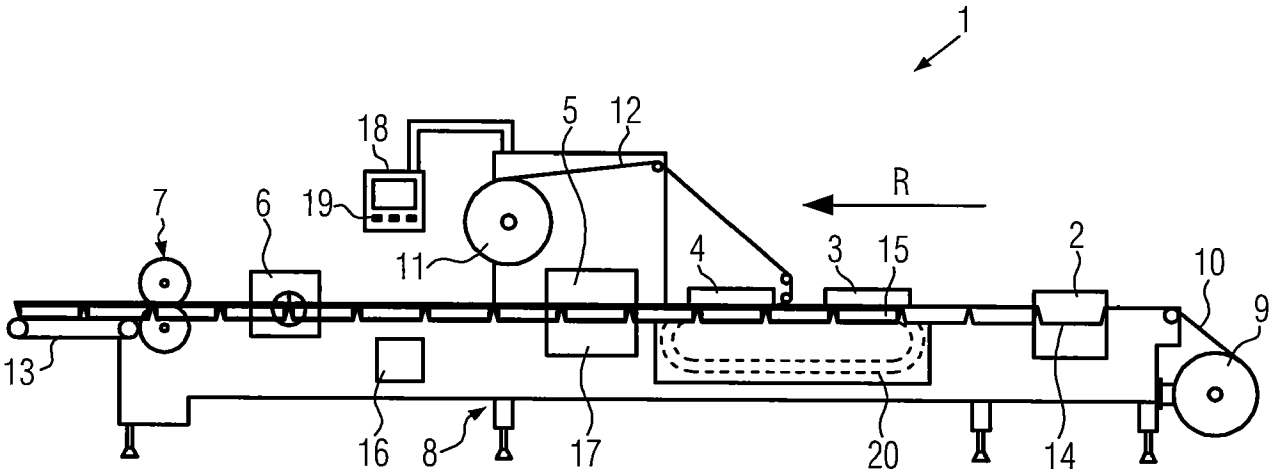
FIG. 1 is a schematic side view of a thermoform packaging machine according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows in a schematic view a packaging machine 1 according to a first embodiment of the present invention in the form of a thermoform packaging machine. As shown, this thermoform packaging machine 1 comprises a forming station 2, an infeed station 3 (loading station), a pre-sealing station 4, a sealing station 5, a transverse cutting unit 6 and a longitudinal cutting unit 7, which are arranged on a machine frame 8 in this sequence, when seen in a production direction R. On the input side, the machine frame 8 can have provided thereon a supply roll 9 from which a film or foil 10 is unwound. A material storage unit 11 may also be provided, from which a cover film or foil 12 is unwound and supplied to the pre-sealing station 4. On the output side, the packaging machine may have provided thereon a discharge unit 13 in the form of a conveyor belt with which finished packages, which have been separated from one another, are transported away. Furthermore, the thermoform packaging machine 1 may include a film conveying unit, which is not shown in detail and which grips the film 10 and advances it in the production direction R during each main operating cycle. The film conveying unit may be configured, for example, as transport chains and clamp chains, respectively, arranged on either side of the film 10 and on the machine frame 8.

In the embodiment shown, the forming station 2 is configured as a thermoforming station, which is used for forming troughs 14 in the film 10 by means of thermoforming. The forming station 2 can be configured such that in the direction perpendicular to the production direction R several troughs are formed side by side. Downstream of the forming station 2, when seen in the production direction R, the infeed station 3 may be provided for filling the troughs 14 formed in the film 10 with products 15.

The sealing station 5 can be provided with a closable chamber 17 in which the atmosphere in the troughs 14 can be substituted, prior to sealing, by an exchange gas or by a gas mixture, for example, by gas flushing.

The transverse cutting device 6 may be configured as a punch separating the film 10 and the cover film 12 in a direction transversely to the production direction R between neighboring troughs 14. In so doing, the transverse cutting device 6 works such that the film 10 is not cut across the whole width of the film, but remains uncut in at least an edge area thereof. This allows controlled further conveyance by the film conveying unit.

In the embodiment shown, the longitudinal cutting device 7 is configured as a blade arrangement by means of which the film 10 and the cover film 12 are cut between neighboring troughs 14 and at the lateral edge of the film 10, so that, downstream of the longitudinal cutting device 7, singulated packages are obtained.

The packaging machine 1 may additionally be provided with a controller 16. It has the function of controlling and monitoring the processes taking place in the packaging machine 1. A display device 18 with operating controls 19 serves to make the sequences of process steps in the packaging machine 1 visible to an operator and to influence them by the operator.

The general mode of operation of the packaging machine 1, according to one embodiment, will be described briefly in the following:

The film 10 is unwound from the supply roll 9 and conveyed into the forming station 2 by the film conveying unit. In the forming station 2, troughs 14 are formed in the film 10 by thermoforming. Together with the area of the film 10 surrounding them, the troughs 14 are advanced, in a main work cycle, to the infeed station 3 where they are filled with a group G of products 15.

Subsequently, the filled troughs 14 are, together with the area of the film 10 surrounding them, advanced by the film conveying unit into the pre-sealing station 4 during the main work cycle. In the course of this process, the products 15 are held in the troughs 14 by means of a holder 20 while the troughs 14 are moved from the infeed station 3 to the pre-sealing station 4 during the main work cycle.

After having been sealed onto the film 10, the cover film 12 is advanced in the pre-sealing station 4 with the feed motion of the film 10. In the course of this process, the cover film 12 is unwound from the material storage unit 11. By sealing the cover film 12 onto the troughs 14, the troughs 14 are covered to such an extent that, in the following work cycles, the products 15 are retained in the troughs 14 without the holder 20 until closed packages are produced in the sealing station 5. The closed packages are separated from one another in the downstream cutting units 6 and 7 and removed from the packaging machine 1 by means of the discharge unit 13.

Figure 2:
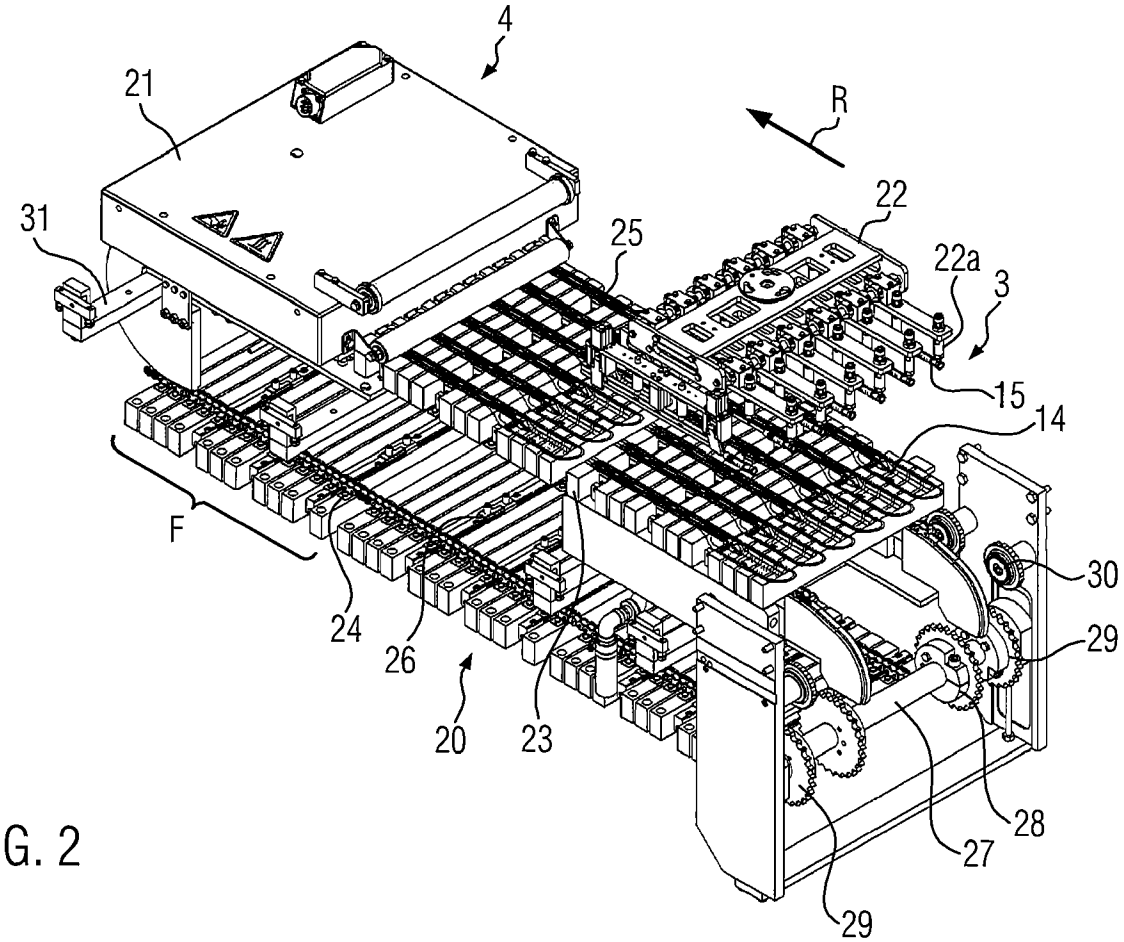
FIG. 2 is a partial top perspective view of a thermoform packaging machine illustrating an infeed station, a gripper and a pre-sealing station according to one embodiment of the present invention.

FIG. 2 shows the pre-sealing station 4 with a pre-sealing tool 21 for sealing the cover film 12 onto the film 10 in certain areas thereof. The infeed station 3 can be provided with a gripper 22 for feeding a group G of six products 15, which may, for example, be catheters, into a row of six troughs 14 in a work cycle. The products 15 can here be advanced to the thermoform packaging machine 1 via a magazine or a conveyor belt, so that they can be gripped by the gripper 22. The gripper 22 may be configured as a two-, three- or four-axle robot and it may be capable of holding a group G of six products 15 by means of vacuum suction devices 22*a*.

The holder 20 can extend from the infeed station 3 to the pre-sealing station 4 and may comprise a plurality of holding segments 23, which are attached to a circulating feed system 24. Eleven holding segments 23, which are adequately designed for accommodating the troughs 14, may form here a respective format F for six troughs 14. Some of the holding segments 23 may have provided between them clamping jaws 25 on clamping strips 26, the clamping strips 26 being movable transversely to the production direction R so as to move two cooperating clamping jaws 25 towards one another for retaining the product 15 in the trough 14 by slightly compressing the film 10 above the inserted product 15 and reducing the opening in size towards the top.

The feed system 24 may comprise a drive shaft 27 having attached thereto two gears 28 for conveying the holding segments 23. Via two additional gears 29 and two respective deflection pulleys 30, the drive shaft 27 and, consequently, the feed system 24 can be driven via the film conveying unit, which is used for conveying the film 10 and which is not shown in detail, in the thermoform packaging machine, preferably by two transport chains for the film 10, which run on either side of the machine frame 8, and are thus mechanically coupled and synchronized with the feed motion of the film 10. As a variant, it is also imaginable that the feed system 24 has a servo drive of its own, which means that the gears 29 and the deflection pulleys 30 could be dispensed with. The holder 20 can comprise four cross members 31, by means of which the holder 20 is attached to the machine frame 8, which is not shown in detail in FIG. 2.

Figure 3:
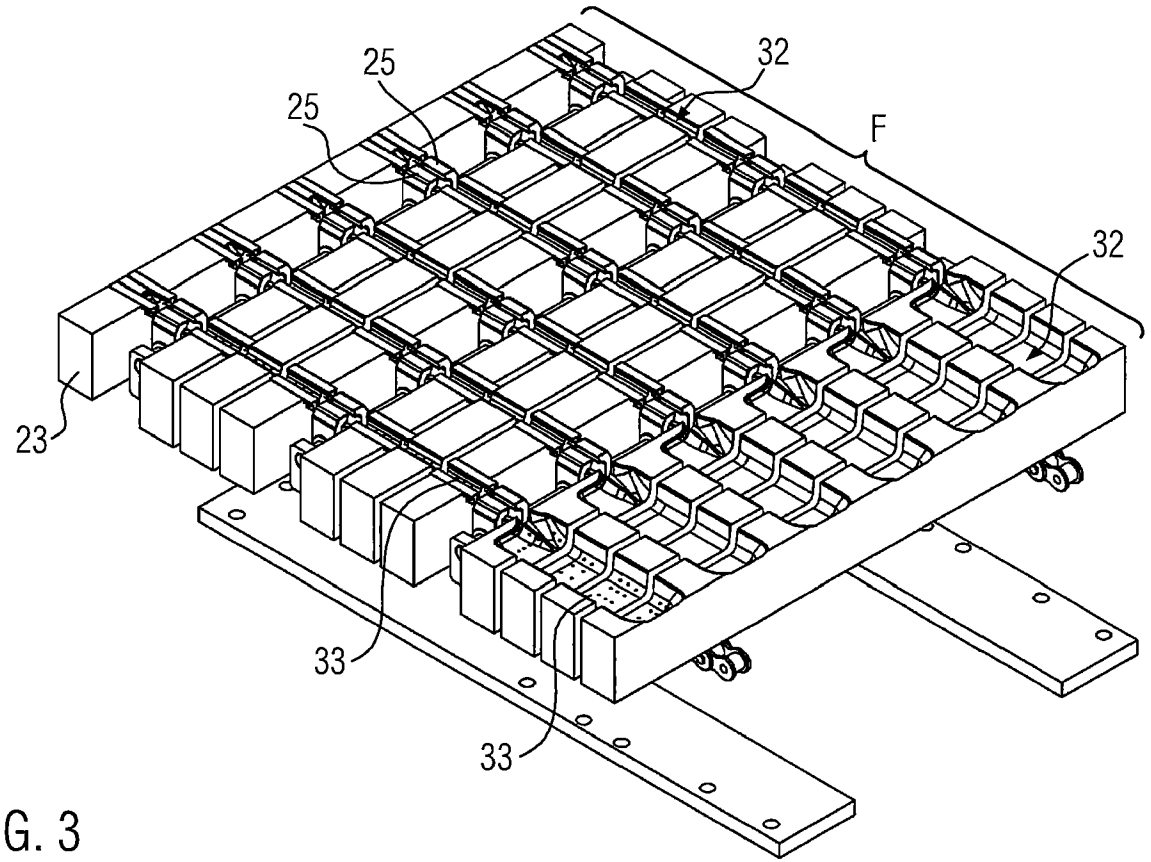
FIG. 3 is a partial top perspective view of a format of a holder according to one embodiment of the present invention.

FIG. 3 shows a single format F of the holder 20 in an enlarged representation without the film 10 and the products 15. The format F comprises eleven holding segments 23. The holding segments 23 have provided therein recesses 32 for accommodating the troughs 14 of the film 10. The recesses 32 of the holding segments 23 have provided therein holes 33 through which a vacuum is applied so as to make the film 10 adhere within the holding segments 23. The product 15 can be fed into the troughs 14 that are held open in this way. In so doing, the products 15 are held from above by means of the gripper 22 and the vacuum suction devices 22*a* and are fed into the troughs 14 from above. The vacuum suction devices 22*a* are active and retain the products 15 until the clamping jaws 25 have been moved towards one another, as shown in FIG. 2, for retaining the products 15 in the troughs 14. The vacuum suction devices 22*a* are then switched inactive and the gripper 22 moves away from the holder 20 so as to fetch a further six products 15 for the next format F, e.g. from a feed belt or magazine. The format F comprising the fed-in and retained products 15 is advanced in the production direction R during the next work cycle.

Figure 4:
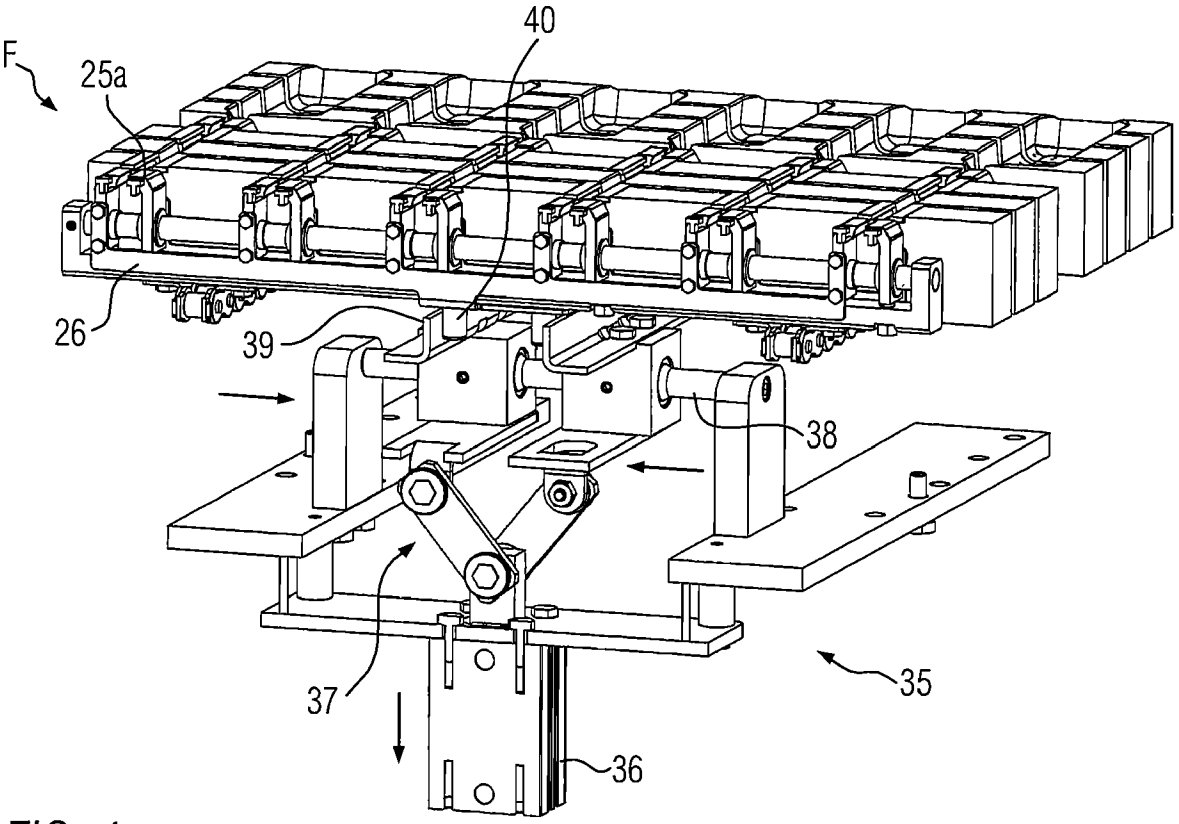
FIG. 4 is a sectional side perspective view of an infeed station in a direction opposite to the production direction illustrating the closed condition of the clamping device according to one embodiment of the present invention.

FIG. 4 shows a section through a format F transversely to the production direction R in the area of the infeed station 3, in which an adjustment drive 35 is shown, which comprises a lifting cylinder 36, a lever mechanism 37 and a guide 38 so that two strips 39 supported on the guide 38 and oriented in the production direction R can be moved towards and away from each other. For moving the strips 39 towards each other, a lower part of the lever mechanism 37, which is connected to the lifting cylinder 36, may be displaced downwards. In the course of this movement, the strips 39 push studs 40, which are each connected to a clamping strip 26, towards each another. Each clamping strip 26 can have attached thereto six clamping jaws 25 for each product 15 in this embodiment, so that two clamping jaws 25 provided around a respective product 15 move towards each other and compress by means of a projection 25*a* the film 10 from two sides so as to reliably retain the product 15 in the trough 14 while it is being conveyed up to and into the pre-sealing station 4. The adjustment drive 35 may be attached to the machine frame 8.

Figure 5:
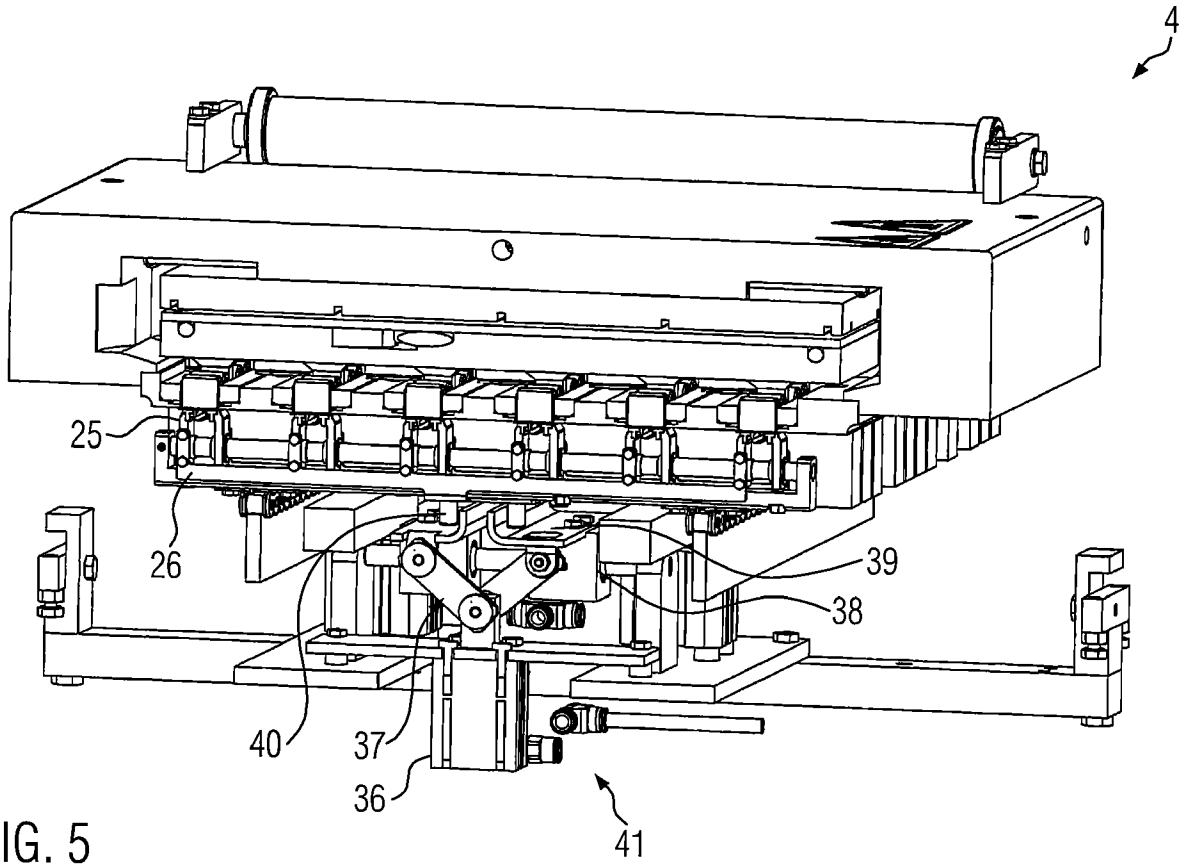
FIG. 5 is a -sectional side perspective view of a pre-sealing station and holder in a direction opposite to the production direction illustrating the open condition of the clamping device according to one embodiment of the present invention.

FIG. 5 shows a section transversely to the production direction R in the area of the pre-sealing station 4 with a further adjustment drive 41, which comprises a lifting cylinder 36, a lever mechanism 37 and a guide 38 so that two strips 39 supported on the guide 38 and oriented in the production direction R can be moved towards and away from each other. For moving the strips 39 away from each other, a lower part of the lever mechanism 37, which is connected to the cylinder 36, can be displaced upwards. In the course of this movement, the strips 39 push the studs 40, which are each connected to the clamping strip 26, away from each other and the clamping jaws 25 move away from each other and remain at this position until the format F has been conveyed back to the infeed station 3 by means of the feed system 24 for receiving therein new products 15. As shown, the adjustment drive 41 is attached to the machine frame 8 via the cross members 31.

Figure 6:
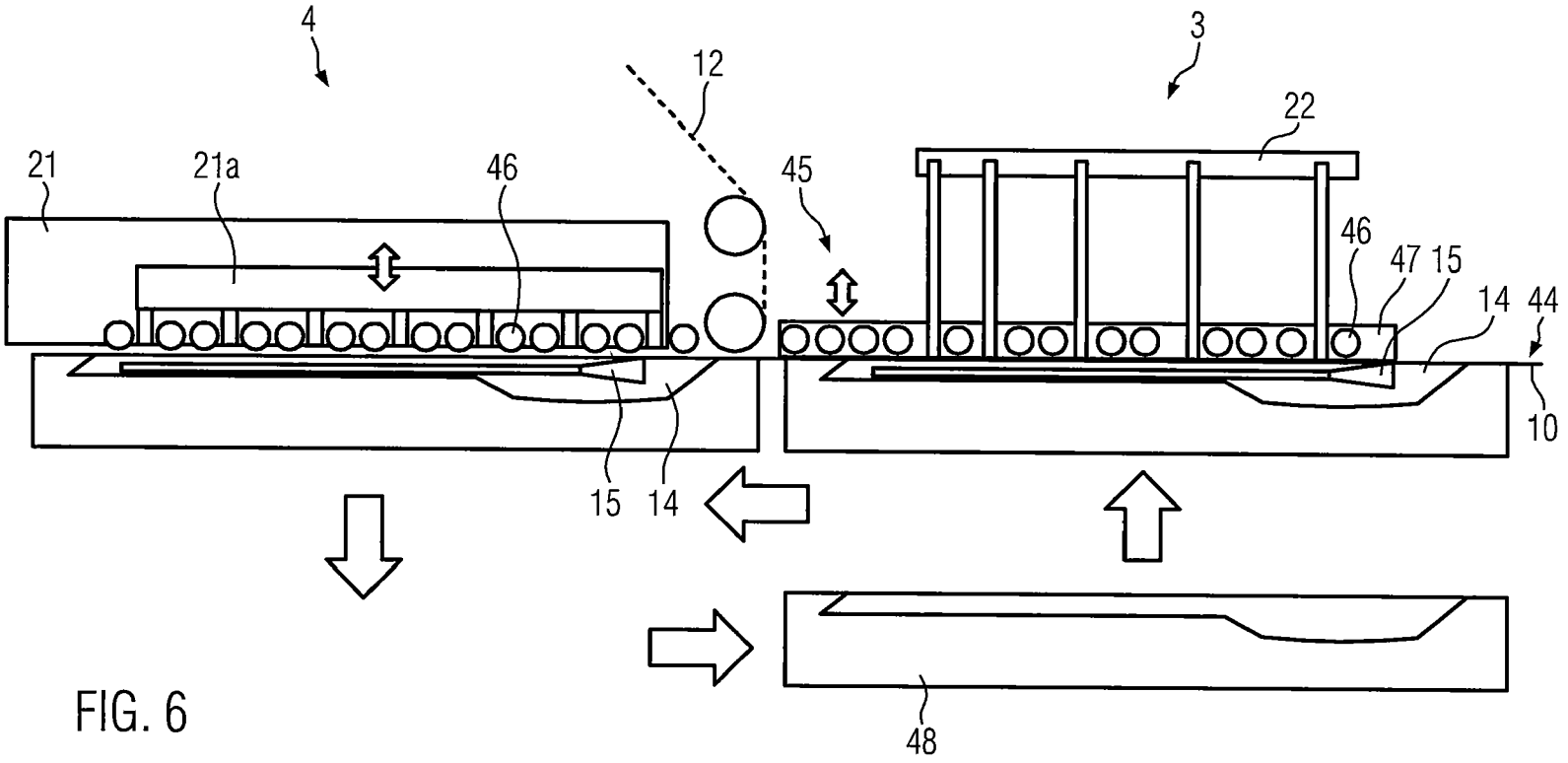
FIG. 6 is a schematic side view of another embodiment of the holder as a paternoster.

An alternative embodiment according to the present invention is shown in FIG. 6. In this embodiment, the pre-sealing station 4 includes a pre-sealing tool 21 and the cover film 12 is supplied to the pre-sealing station 4. The pre-sealing station 4 may also be configured as a sealing station 5 and seal the cover film 12 onto the film 10 with a circumferentially extending sealed seam. The infeed station 3 may comprise the gripper 22 for feeding the products 15 into the troughs 14. A holder 44 can include a downholder 45 having attached thereto a plurality of rollers 46 on strips 47. The downholder 45 may be adjustable vertically or transversely to the production direction R so as to allow the gripper 22 to feed the products 15 into the troughs 14 from above. When the products have been fed in, the downholder 45 is moved downwards or to the side to a position above the products 15 such that said products 15 are retained in the troughs 14 during the movement in the production direction R. The downholder 45 comprises, for example, a respective strip 47 with thirteen rollers 46 for the individual products 15.

The pre-sealing tool 21 may comprise a plurality of rollers 46, which are arranged above the products 15 so as to retain said products 15 in the troughs 14. The pre-sealing tool 21 can comprise a pre-sealing frame 21*a*, which, by means of so-called spot seals, fastens the cover film 12 to the film 10 at a plurality of positions between the rollers 46.

In one embodiment, the holder 44 comprises at least two dies 48 for receiving therein the troughs 14 and the products 15, respectively. In FIG. 6 three dies 48 are shown. The dies 48 may be arranged such that a die 48 is moved in the production direction R from the infeed station 3 to the pre-sealing station 4 in synchronism with the feed motion of the thermoform packaging machine 1 for sealing, in said pre-sealing station 4, the cover film 12 partially onto the film 10 such that the product 15 will be retained reliably in the trough 14 until full sealing of the cover film 12 onto the film 10 will finally take place in the sealing station 5. For returning the die 48, the die may be lowered in the pre-sealing station 4 after the sealing process and conveyed, in a direction opposite to the production direction R, to the infeed station 3 by a conveyor system, which is not shown in detail, and moved upwards for feeding in new products 15 by means of the gripper 22 so that it will come into contact with the film 10 and receive the troughs 14. Also according to this embodiment, holes 33 for applying a vacuum may be provided in the die 48.

Figures 7A, 7B, 7C:
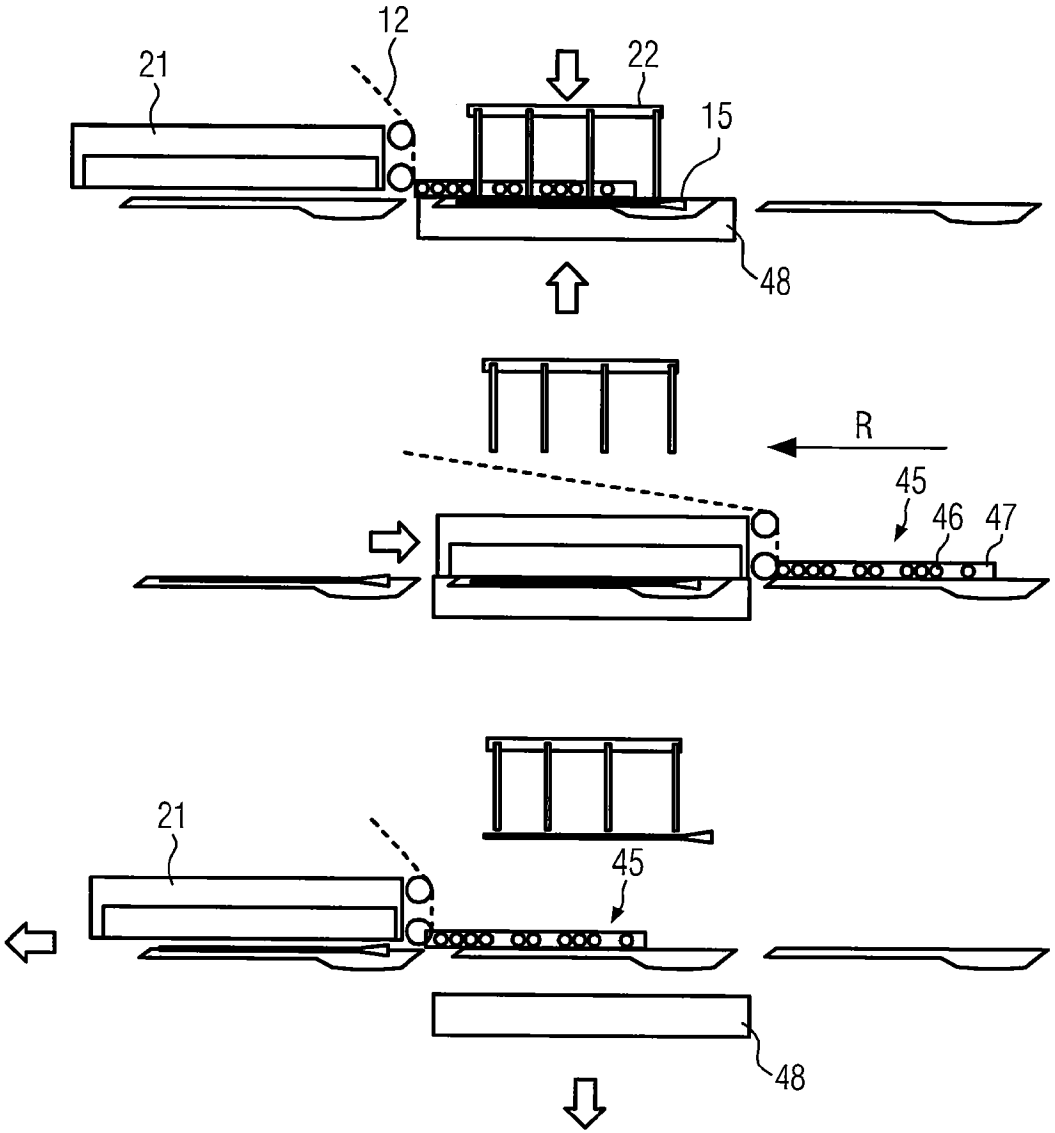
FIG. 7*a* is a schematic side view of a further embodiment of the holder with a sealing station movable along the production direction illustrating in a first position according to one embodiment of the present invention.
FIG. 7*b* is a schematic side view of the holder of FIG. 7*a* with a sealing station movable along the production direction illustrating in a second position according to one embodiment of the present invention.
FIG. 7*c* is a schematic side view of the holder of FIG. 7*a* with a sealing station movable along the production direction illustrating in a third position according to one embodiment of the present invention.

Another embodiment according to the present invention is shown in FIGS. 7*a*, 7*b* and 7*c*. In this case, it is not the die 48, but the pre-sealing tool 21, that is movable in or opposite to the production direction R. FIG. 7*a* shows the situation while the products 15 are being fed into the troughs 14 by means of the gripper 22, the die 48 is occupying an upper working position.

In FIG. 7*b*, the pre-sealing tool 21 with the downholder 45 has been moved in a direction opposite to the production direction R such that the pre-sealing tool 21 is located directly above the die 48. In the course of this movement, also the cover film 12 has been unwound and placed on top of the film 10. Previously, the gripper 22 has been removed from the area of collision with the pre-sealing tool 21. The cover film 12 may be fixed to the film 10 in this work cycle.

In FIG. 7*c*, the die 48 has been lowered to a release position so as to allow a collision-free movement of the pre-sealing tool 21 and of the downholder 45 as well as of the troughs 14 in the production direction R. The newly supplied troughs 14 may have products 15 inserted therein more than once, when the die 48 has been re-raised to its working position (cf. FIG. 7*a*).

In addition to its movement along the production direction R, the downholder 45 can also be moved vertically or transversely, as shown in the variant according to FIG. 6, so as to allow the products 15 to be fed into the troughs 14 by means of the gripper 22.

The movement of the pre-sealing tool 21 can be carried out by means of a servo drive or a pneumatic cylinder. Preferably, the downholder 45 is mechanically coupled with the pre-sealing tool 21 or it is adapted to be moved approximately in synchronism with the pre-sealing tool 21 by means of an adjustment drive of its own.

Also in the embodiment according to FIGS. 7*a* to 7*c*, holes 33 for applying a vacuum may be provided in the die 48. The pre-sealing tool 21 may also be configured as a sealing tool so as to produce a circumferentially extending sealed seam.

In the case of all embodiments, the products 15 may be fed in manually or individually through the gripper 22.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A thermoform packaging machine comprising:

a forming station for forming a plurality of troughs in a film;

an infeed station;

a sealing station with a sealing tool; and a holder for receiving the plurality of troughs and retaining a product in each of the troughs, wherein the holder comprises a plurality of clamping strips disposed for movement between a product retaining position and a product loading position and wherein each of the plurality of clamping strips includes a plurality of clamping jaws;

wherein the holder is disposed for movement relative to said sealing tool in a production direction of the thermoform packaging machine.

2. The thermoform packaging machine according to claim 1, wherein the holder comprises said clamping jaws positioned for retaining products at a plurality of positions in the troughs.

3. The thermoform packaging machine according to claim 1, wherein the clamping strips are adapted to be moved in common by an adjustment drive relative to one another such that the clamping jaws close upon the products in the troughs in the product retaining position.

4. The thermoform packaging machine according to claim 1, wherein the holder comprises a plurality of holding segments arranged on a circulating feed system.

5. The thermoform packaging machine according to claim 4, wherein the holder is adapted to be intermittently conveyed in synchronism with a film conveying unit for the film in said production direction into the sealing station for pre-sealing a cover film onto the film.

6. The thermoform packaging machine according to claim 5, wherein the holder is mechanically coupled to the film conveying unit for the film.

7. The thermoform packaging machine according to claim 1, wherein the infeed station includes a gripper for feeding a group of flexible and partially curved products into the troughs.

8. The thermoform packaging machine according to claim 1, wherein the holder includes a downholder configured for retaining products at a plurality of positions in the troughs and the film.

9. The thermoform packaging machine according to claim 1, wherein the holder includes a die for a group of products, said die being vertically movable by means of a lifting device.

10. The thermoform packaging machine according to claim 9, wherein the sealing tool is movable in a direction opposite to the production direction to a position above the die for sealing a cover film onto the film.

11. The thermoform packaging machine according to claim 1, wherein the clamping strips are disposed for a movement in a direction substantially perpendicular to the direction of production.

12. The thermoform packaging machine according to claim 1, wherein clamping strips are disposed in the product retaining position and engage the product in each of the plurality of the troughs as the holder, the product in each of the plurality of the troughs moves from the infeed station toward said sealing tool in the production direction.

13. A method for operating an intermittently working thermoform packaging machine for packaging a group of flexible and partially curved products, said method comprising the steps of:

forming troughs in a film;

feeding the group of products into the troughs in an infeed station, the troughs being positioned in a holder during the feeding step;

moving the holder, the troughs and the products positioned in the holder relative to the sealing tool of a sealing station in a direction of production of the thermoform packaging machine; and retaining the products with a plurality of clamping jaws in the holder while the holder, the trough and the products are moved relative to said sealing tool.

14. The method according to claim 13, wherein the step of retaining of the products begins when the products have been fed in, and ends after sealing.

15. The method according to claim 13, wherein said moving the holder step further comprises moving a format of holding segments.

16. The method according to claim 13, further comprising feeding the products into the troughs with a gripper.

17. The method according to claim 13, further comprising the steps of sealing the products in the troughs, and conveying the holder back to the infeed station with a circulating feed system.

* * * * *